US008091987B2

(12) United States Patent
Van Den Bergen

(10) Patent No.: US 8,091,987 B2
(45) Date of Patent: Jan. 10, 2012

(54) INK JET PRINT HEAD WITH IMPROVED RELIABILITY

(75) Inventor: Patrick Van Den Bergen, Mortsel (BE)

(73) Assignee: XAAR PLC, Cambridge (GB)

( * ) Notice: Subject to any disclaimer, the term of this patent is extended or adjusted under 35 U.S.C. 154(b) by 0 days.

(21) Appl. No.: 11/994,932

(22) PCT Filed: Jun. 13, 2006

(86) PCT No.: PCT/EP2006/063147

§ 371 (c)(1),
(2), (4) Date: Feb. 25, 2008

(87) PCT Pub. No.: WO2007/006618

PCT Pub. Date: Jan. 18, 2007

(65) Prior Publication Data

US 2008/0316278 A1 Dec. 25, 2008

Related U.S. Application Data

(60) Provisional application No. 60/700,148, filed on Jul. 18, 2005.

(30) Foreign Application Priority Data

Jul. 7, 2005 (EP) ..... 05106209

(51) Int. Cl.
*B41J 2/05* (2006.01)
*B41J 2/045* (2006.01)
*B41J 2/02* (2006.01)

(52) U.S. Cl. ..... 347/65; 347/68; 347/73

(58) Field of Classification Search ..... 347/65, 347/69, 89

See application file for complete search history.

(56) References Cited

U.S. PATENT DOCUMENTS 5,155,498 A * 10/1992 Roy et al. ..... 347/11
5,189,437 A 2/1993 Michaelis et al.
5,278,584 A 1/1994 Keefe et al. ..... 347/63
5,748,214 A 5/1998 Usui et al. ..... 347/70
5,818,485 A * 10/1998 Rezanka ..... 347/89

(Continued)

FOREIGN PATENT DOCUMENTS

EP 0 277 703 1/1988

(Continued)

OTHER PUBLICATIONS

Ishikawa, Hiroyuki, Method of Manufacturing, Apr. 10, 2001, Machine Translation of JP 2001096753 A, Paragraphs 22-23 and 26.*

(Continued)

*Primary Examiner* — Matthew Luu
*Assistant Examiner* — Lisa Solomon
(74) *Attorney, Agent, or Firm* — Marshall, Gerstein & Borun LLP

(57) ABSTRACT

An ink jet print head is provided having an ink chamber and a nozzle plate closing the ink chamber at an end comprising a nozzle for ejecting a drop of ink through it. The nozzle plate further includes an ink path for flowing an ink through in a direction parallel with the nozzle plate and passing the inner end of the nozzle. This ink flow is in excess of that required for replenishing the ejected drops of ink in the ink chamber and may flow continuously passed the inner end of the nozzle and along the ink path to refresh the ink that is used for ejecting through the nozzle.

22 Claims, 9 Drawing Sheets

U.S. PATENT DOCUMENTS

| | | | | |
|---|---|---|---|---|
| 6,244,694 | B1 * | 6/2001 | Weber et al. | 347/65 |
| 6,705,705 | B2 | 3/2004 | Horvath et al. | 647/50 |
| 2002/0051039 | A1 | 5/2002 | Moynihan et al. | |

FOREIGN PATENT DOCUMENTS

| | | | |
|---|---|---|---|
| EP | 0 278 590 | | 8/1988 |
| JP | 5-8187369 | | 11/1983 |
| JP | 2001 096753 | | 4/2001 |
| JP | 2001096753 | A * | 4/2001 |
| WO | WO 98/02577 | | 1/1998 |
| WO | WO 00/38928 | | 7/2000 |
| WO | WO 01/08888 | | 2/2001 |

OTHER PUBLICATIONS

International Search Report for PCT/EP2006/063147 dated Aug. 29, 2006.

* cited by examiner

INK JET PRINT HEAD WITH IMPROVED RELIABILITY

FIELD OF THE INVENTION

The present invention relates to an apparatus and a method for on demand ejecting drops of ink from an ink chamber via a nozzle. More specifically the invention is related to improved reliability of the drop-on-demand apparatus.

BACKGROUND OF THE INVENTION

Printers are used to print output from computers, or similar type of devices that generate information, onto a recording medium such as paper. Commonly available types of printers include impact printers, laser printers and ink jet printers. The term "ink jet" covers a variety of physical printing processes and hardware but basically transfers ink from an ink supply to the recording medium in a pattern of fine ink drops. Ink jet print heads produce drops either continuously or on demand. "Continuously" means that a continuous stream of ink drops is created, e.g. by pressurizing an ink supply. "On demand" differs from "continuous" in that ink drops are only generated on demand, by manipulation of a physical process to momentarily overcome surface tension forces that keep an ink in the meniscus of a nozzle. The nozzle is located in a boundary surface of a small ink chamber. The most common practice is to suddenly raise the pressure on the ink in the ink chamber, thereby breaking the meniscus and ejecting a drop of ink from the nozzle. One category of drop-on-demand ink jet print heads uses the physical phenomenon of electrostriction, a change in transducer dimension in response to an applied electric field. Electrostriction is strongest in piezoelectric materials and hence these print heads are referred to as piezoelectric print heads. The very small dimensional change of piezoelectric material is harnessed over a large area to generate a volume change that is large enough to squeeze out a drop of ink from the ink chamber. A piezoelectric print head may include a multitude of ink chambers, arranged in an array, each chamber having an individual nozzle and a percentage of transformable wall area to create the volume change required to eject an ink drop from the nozzle, in accordance with electrostriction principles. Another category of drop-on-demand ink jet print heads uses heater-resistors in the ink chambers. A short voltage pulse is applied to the heater-resistor, thereby warming up the ink in contact with the resistor sufficiently for the ink near the contact surface to boil. The local liquid-to-vapor transition results in a local volume expansion of the liquid. This local volume expansion generates a pressure pulse ejecting a drop of ink out of the nozzle. Most of the on-demand ink jet print heads are characterized by having elongated chambers and a nozzle at one end of these chambers. These devices are therefore often referred to as end-shooter devices.

A problem with such end-shooter devices is that during periods of non-use, the ink that is retained in the ink chambers may deteriorate and lead to sedimentation of solid particles from the ink in the chamber. Deterioration of the ink in the chamber may also include evaporation of VOC's (volatile organic compounds) contained in the ink, at the ink meniscus. This may lead to a change in viscosity of the ink in the vicinity of the nozzle, having a negative effect on its jetting properties. Sedimentation and evaporation of ink components may potentially lead to a nozzle fall out or nozzle blockage. Another problem often causing operating failure of the print head is the presence of air bubbles in the ink chamber of end-shooter print heads. All these effects reduce the reliability of end-shooter print heads.

Some of these problems are addressed in U.S. Pat. No. 5,155,498. In this patent specification the print head includes an additional purging channel in the actuator of the ink jet print head. This channel allows ink to be flushed through the ink chamber and through the purging channel during a purging operation. The solution enables an improved maintenance of end-shooter print heads by a dedicated design of the ink flow in the print head actuator. A disadvantage of the purging channel however is that the ink is only replenished periodically, i.e. only during the purging operations. European patent EP 1 200 266 suggests an alternative print head design. This patent provides a continuous flow of ink in the ink chamber by dividing the ink chamber in an input or supply compartment and an output or drain compartment. The ink may continuously flow from input to output, thereby also replenishing the ink near the nozzle. A disadvantage of the proposed solutions however is that they include modifications to the basic geometry and acoustic behavior and operating conditions of the end-shooter ink chambers in the print head, and that the applicability of the proposed solutions are strongly related to the piezo shear mode technology. In U.S. Pat. No. 5,818,485 a continuous ink path is established through a side shooter thermal ink jet print head by forming ink channels in various internal portions of the print head. The invention suffers from similar disadvantages than the invention disclosed in EP 1 200 266 in that it requires adaptations to the ink chamber.

It would therefore be advantageous to have a improved print head and a method for reliably ejecting drops of ink from an ink chamber, based on established and proven end-shooter type print head designs, and without changing these proven designs.

SUMMARY OF THE INVENTION

In one embodiment of the invention a print head is provided having an ink chamber and a nozzle plate closing the ink chamber at an end, the nozzle plate comprising a nozzle for ejecting a drop of ink through it. The nozzle plate further includes an ink path for flowing through an amount ink, in a direction parallel with the nozzle plate and past the inner end of the nozzle. This ink is in excess of that required to replenish the ejected drops from the print head and may flow continuously past the inner end of the nozzle and along the ink path to refresh the ink that is used for ejecting through the nozzle.

In another embodiment of the invention a method of printing is provided including the step of creating an ink flow in excess of that required to replenish the ejected drops from a print head, and passing that flow of ink along the inner end of the nozzle and through an ink path in the nozzle plate. The ink flow refreshes the ink that will be used for ejecting through the nozzle.

Specific features for preferred embodiments of the invention are set out in the dependent claims.

The advantages of the present invention will become apparent from the following description and drawings.

DETAILED DESCRIPTION OF THE INVENTION

While the present invention will hereinafter be described in connection with preferred embodiments thereof, it will be understood that it is not intended to limit the invention to those embodiments.

Figure 1:
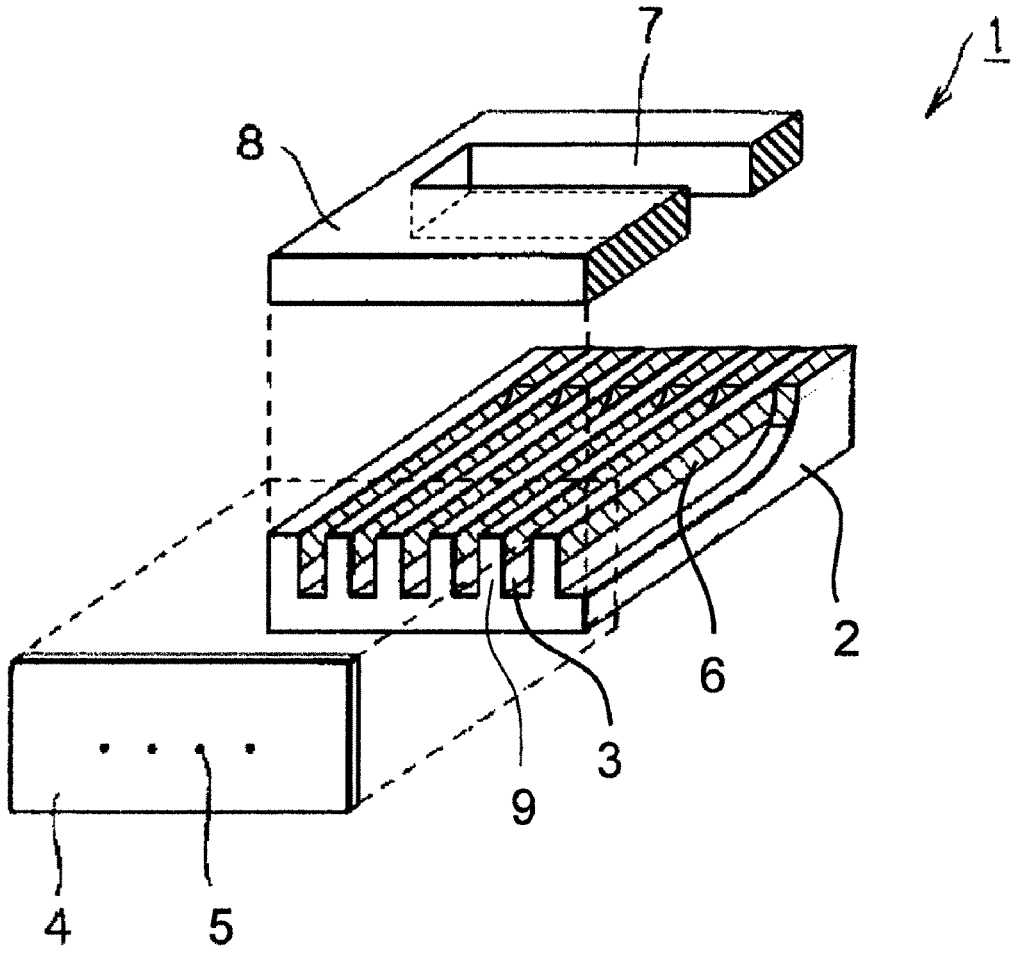
FIG. 1 shows a simplified view of a prior art end-shooter print head actuator.

In the description, reference is made to a piezoelectric ink jet print head, although the invention is also applicable to thermal ink jet print heads. In general, every ink jet print head has a print head actuator having a plurality of ink chambers, and a nozzle plate having a plurality of corresponding nozzles. The nozzle plate is attached to the print head actuator closing the ink chambers at one end in a way that every ink chamber communicates with a corresponding nozzle. The drawings used in the descriptions will illustrate the invention implemented on a piezoelectric ink jet print head. The term 'nozzle plate' will cover any type of nozzle plate known in the art used for ink jet print heads. These include polyimide, stainless steel or silicon nozzle plates, single member nozzle plates or nozzle plate assemblies, e.g. a plurality of nozzle plates aligned and fixed to a support member, and may include any shape of nozzles known in the art. The term 'print head actuator' is defined as a print head sub-assembly comprising the ink chambers and drop ejection actuating means. A prior art example of a print head actuator that may be used with the present invention is the assembly of piezoelectric actuator 2 and cover plate 8 shown in FIG. 1. The print head actuator is attached to nozzle plate 4 having an array of nozzles 5 that are aligned with the corresponding array of ink chambers 3. Ink is supplied to the array of ink chambers via ink inlet 7 in the cover plate. The piezoelectric actuator has vertical chamber walls 9 separating the chambers and electrodes 6 covering at least part of these chamber walls to create the electrostriction effect. FIG. 1 is an illustration of an end-shooter type print head 1. By "end-shooter" we mean a configuration in which the nozzle is at the end of an elongated ink chamber, actuating means are located along a long side of the chamber, and ink flow in the elongated chamber is perpendicular to the nozzle plate. In piezoelectric side-shooter print heads, the nozzle is disposed in one of the long sides of the chamber which is not provided with piezoelectric actuating means, and the ink flow in the elongated chamber is parallel with the nozzle plate. Side-shooter print heads used in thermal ink jet technology are characterized by having an ink flow parallel with the thermal actuating means and wherein the nozzle is placed away from the thermal actuating means. In a roof-shooter print head, piezoelectric or thermal, the nozzle is located opposite to the actuating means in the ink chamber, and disposed in a nozzle plate mounted as a cover to the ink chamber. The invention may be used with any one of these print head types.

Ink Return Path

Figure 2A:
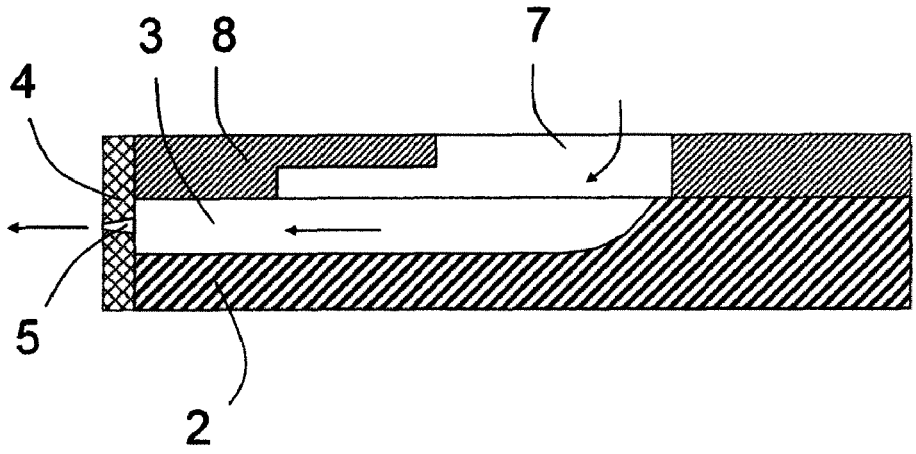
FIG. 2A shows a simplified longitudinal cross-section, along the length of an ink chamber, of a prior art end-shooter print head shown in FIG. 1.
Figure 2B:
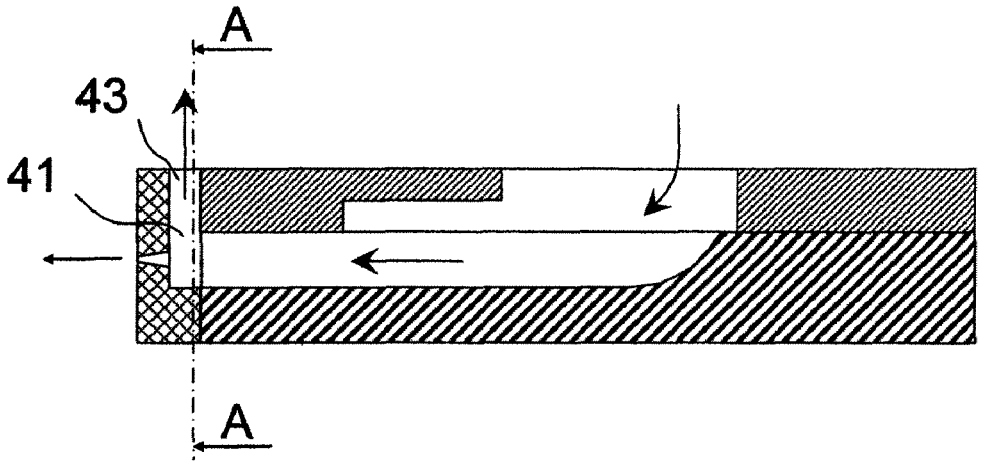
FIG. 2B shows a first embodiment of the invention having an ink path in the nozzle plate for returning ink from the ink chamber.

In FIG. 2A a cross-sectional view along the length of an ink chamber of a prior art print head similar to the one illustrated in FIG. 1 is shown. The various parts have been given the same numeral reference as in FIG. 1 and are therefore not discussed again. The arrows indicate the ink flow direction. FIG. 2B shows a cross-sectional view of a print head according to the invention. Some features have been exaggerated for the purpose of clear understanding. In FIG. 2B, the ink jet print head is provided with an ink outlet 41 at the end of the ink chamber 3. The ink outlet is part of an ink return path 43 in the nozzle plate, that allows ink to be continuously drained from the ink chamber 3. The ink that is withdrawn from the ink chamber is continuously replenished with new ink via the ink inlet 7 to the ink chamber. As indicated in FIG. 2B there are two ink flows, i.e. a print-flow from the ink inlet through the ink chamber and the nozzle onto the printing medium, and a through-flow from the ink inlet through the ink chamber and the ink return path back to a supply of ink. The print-flow is substantially perpendicular to the nozzle plate. The direction of the through-flow is from substantially perpendicular to the nozzle plate in the ink chamber to substantially parallel to the nozzle plate in the ink return path. In the embodiment shown in FIG. 2B, the through-flow makes a 90° turn at the nozzle. The configuration in FIG. 2B is repeated for every ink chamber in the array of ink chambers in the print head. Every ink chamber has a corresponding ink return path, so that the array of ink chambers of the print head actuator corresponds with an array of ink return paths in the nozzle plate. The ink inlets and ink outlets to the individual ink chambers in this array may be connected to a common inlet manifold respectively outlet manifold, covering the width of the array of ink chambers. See FIG. 3 for a perspective view of an inlet/outlet manifold part. A nozzle plate according to the invention will further be referred to as a "through-flow nozzle plate".

Figure 4:
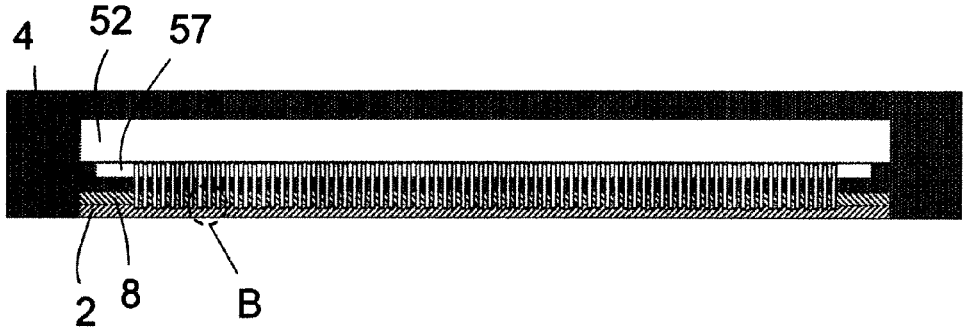
FIG. 4 shows a possible location of ink paths according to the invention relative to a through-flow manifold as shown in FIG. 3.
Figure 5:
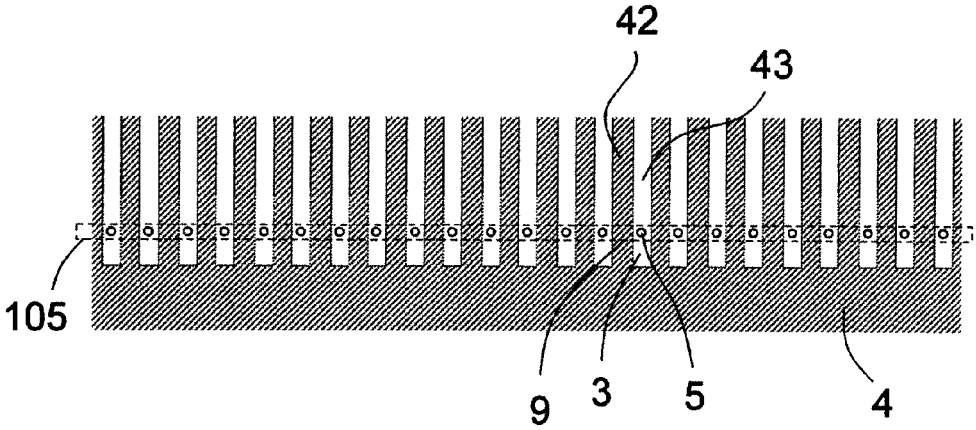
FIG. 5 shows a detail of the ink paths in a nozzle plate according to the invention.

The ink return path may be realized as an ink channel in the nozzle plate, with a given depth, width and length. The dimensions are chosen in view of a desired ink flow through the channel, a maximum pressure drop across the channel, and a minimal impact of the additional ink outlet on the drop generation and ejection process in the ink chamber. An array of ink return paths is illustrated in the FIGS. 4 and 5. FIG. 5 shows a number of ink return paths realized as straight channels in a through-flow nozzle plate. The figure is a cross-section according to cut 'A' in FIG. 2B and corresponds with detail 'B' of a full view of the ink return paths configuration as shown in FIG. 4. The ink return channels 43 including the nozzles 5 are aligned with the ink chambers 3, the alignment is indicated with dotted lines in FIG. 5. The banks 42 in between the channels are aligned with the ink chamber walls 9. When the through-flow nozzle plate is attached to the print head actuator, the channel banks contact the ink chamber walls and create the hydraulic isolation between the ink chambers so that hydraulic cross-talk between neighboring ink chambers is prevented. In a preferred embodiment, the width of the ink return channels is chosen to be substantially equal to the width of the ink chambers, and starting off at the bottom of the ink chambers. When affixed to the print head actuator, the ink return channels in the nozzle plate form an extension of the ink chambers. The depth of the ink return channels is relatively small compared to the length of the ink chambers, thereby minimizing the effect of the ink chamber extension on the ink drop generation and ejection process.

A through-flow nozzle plate may be chosen to be thicker than a regular nozzle plate. In a preferred embodiment the thickness of a through-flow nozzle plate is chosen so that the residual thickness of the through-flow nozzle plate in the return channels is substantially equal to overall thickness of a regular nozzle plate. The advantage of a thicker nozzle plate is that the ink return channels do not reduce the overall mechanical stiffness and strength of the nozzle plate. The thicker through-flow nozzle plate is also advantageous in view of preserving the nozzle shape and dimensions when moving from a regular nozzle plate to a through-flow nozzle plate, especially because the nozzle characteristics are important parameters in the ink drop ejection process. E.g. a through-flow nozzle plate may be chosen to have a thickness of 125 μm, compared to a regular nozzle plate thickness of 50 μm. The depth of the ink return channels may then be chosen to be 75 μm so that the remaining thickness of the through-flow nozzle plate, at the locations where the nozzle is to be created, is 50 μm which allows the creation of nozzles identical to those in a regular nozzle plate. The width of the ink return channels may be chosen to be equal to the width of the ink chambers of the print head actuator, e.g. 75 μm. Ink return channels of 75 μm wide and 75 μm deep create an ink outlet cross-section of 75 by 75 μm. It has been shown that these dimensions allow a sufficient flow of ink through the ink return paths to provide a continuous refresh of the ink in the ink chamber to prevent problems as described in the 'background of the invention' section. Of course, other dimensions may be chosen depending on specific details of the print head actuator. A trade-off may be required between ink return channel depth and nozzle depth. E.g. experiments showed that a through-flow polyimide nozzle plate of 125 μm with channels of 90 μm depth to create more flow through the channels, therefore leaving nozzles of only 35 μm depth, operates just as well with standard print head actuation controls. Also other thicknesses of through-flow nozzle plates may be selected to allow the manufacture of deeper ink return channels without jeopardizing the nozzle manufacture or nozzle operation. The shape and orientation of the ink return paths in the through-flow nozzle plate is not limited to parallel straight channels; their trajectory may have any shape and may for example depend on the location of bonding pads for the through-flow nozzle plate onto the print head actuator. The ink return pads may for example fan out towards their ends like a grass rake.

Ink Manifold

Figure 3:
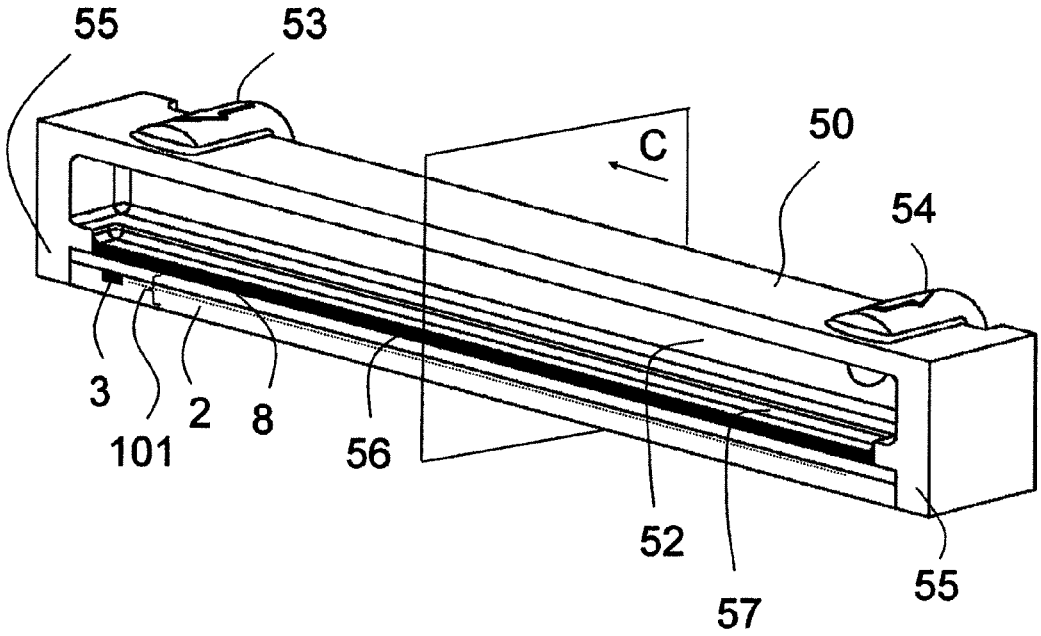
FIG. 3 shows a perspective view of a through-flow manifold attached to a print head actuator.
Figure 6:
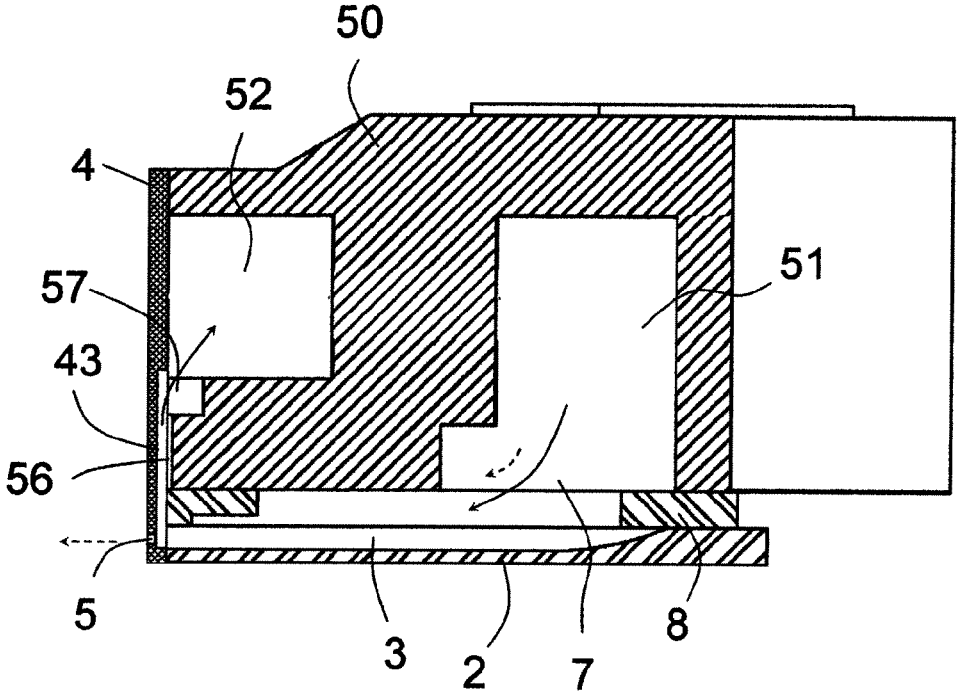
FIG. 6 shows a cross-section of the assembly of a print head actuator covered with the through-flow manifold and attached thereto a nozzle plate according to the invention.

The array of ink inlets to the ink chambers and the array of ink return paths coming from the ink chambers may respectively be connected to an inlet manifold 51 and an outlet manifold 52. These manifolds may be separate parts of the print head structure or they may be integrated in a single part. In the remainder of the description, reference will be made to a single part called a through-flow manifold 50, incorporating both the inlet manifold and the outlet manifold. A perspective view of a through-flow manifold attached to a print head actuator is shown in FIG. 3. The through-flow manifold shown in FIG. 3 is designed as a cover on top of the print head actuator. In the specific embodiment of FIG. 3, the through-flow manifold is wider than the array of ink inlets or ink return paths and covers the top, left and right sides of the print head actuator. In a manner of speaking, the print head actuator is inserted in the bottom area of the through-flow manifold between the two lugs 55 to create a print head sub-assembly. The bottoms of the print head actuator and the through-flow manifold are aligned. The outlet manifold 52 is shown as a cavity at the front of the through-flow manifold, extending substantially along the full width of the print head actuator, and having an entry trench 57 at the bottom. The ink that is returned from the ink chambers of the print head actuator via the array of ink return paths in front of the assembly of FIG. 3 (not shown), enters the entry trench of the outlet manifold and is collected in the cavity and drained via connection piece 54. The inlet manifold 51 (not visible) is situated behind the outlet manifold with the opening towards the ink inlet in the cover plate of the print head actuator. The ink inlet manifold is supplied with ink via connection piece 53. A cross-section according to cut C in FIG. 3 is shown in FIG. 6. A through-flow nozzle plate as shown in FIGS. 4 and 5 is added in front of the manifold and print head actuator assembly. The relative position of the inlet and outlet manifolds in this specific embodiment is shown.

Through-Flow Nozzle Plate Attachment

In front of the through-flow manifold and print head actuator sub-assembly, a through-flow nozzle plate 4 incorporating the array of nozzles 5 and ink return paths 43 is attached. FIG. 4 shows the relative position of the array of ink return paths versus the through-flow manifold and front of the print head actuator. A cross-section of the entire assembly of print head actuator, through-flow manifold and through-flow nozzle plate is shown in FIG. 6.

Several methods are known in the art to attach a nozzle plate to a print head actuator and ink manifold. A method may be used wherein the sub-assembly of the through-flow manifold and print head actuator is dipped into a thin layer of glue, then positioned in front of and aligned with the through-flow nozzle plate, and subsequently affixed to the through-flow nozzle plate. A problem of incomplete bonding of the nozzle plate onto the front surface of the print head actuator may arise when the through-flow manifold in the sub-assembly protrudes relative to the front surface of the print head actuator, especially at the joint with the cover plate. The protrusion of the through-flow manifold relative to the front of the print head actuator creates an hangover at the joint between the two pieces. The nozzle plate may not be able to conform to this hangover and leave gaps in the bonding surface enabling a lateral ink flow between neighboring ink return channels and cross-talk between the corresponding ink chambers. In order to prevent these deficiencies, an area 56 at the front side of the through-flow manifold (see FIG. 3) may be indented relative to the rest of the through-flow manifold front surface. The indentation will absorb tolerances in the alignment between the through-flow manifold and the print head actuator. An indentation of e.g. 100 μm may be sufficient to prevent overhang of the through-flow manifold part relative to the print head actuator.

Operation

The operation of an ink jet print head as shown in FIG. 1 is based on electrostriction of the piezoelectric ink chamber walls. A shear force, resulting from the application of an electric field across the piezoelectric walls, deforms these walls while the top and bottom of the walls remain fixed to the cover plate respectively bottom plate of the actuator. At frequencies in the order of a few MHz, the electrostriction of the PZT walls creates rapid changes in the ink chamber volume, changes that are transferred to the ink as pressure pulses creating pressure waves in the ink chamber.

Amplitude, frequency and timing of these pressure waves, introduced by shear mode operating PZT walls, can be used to control the ink drop generation and ejection process. The ink chamber acts like a hydrodynamic resonance box for the pressure waves. The dimensions of the ink chamber are therefore also parameters to control the ink drop generation and ejection process. It is an advantage of the present invention that these ink chamber related boundary conditions for the drop generation and ejection process are hardly influenced by the introduction of the through-flow nozzle plate. The print head actuator design is not at all changed, and the ink return path at the end of the ink chamber only adds a small volume to the hydrodynamic resonance box.

The hydrodynamic effects in the ink chamber generate and eject drops at a rate of some tens of kHz. In a commercially available print head operating at these frequencies, e.g. the OmniDot print head manufactured by Xaar plc (UK), an ink volume in the order of 0.5 to 1 ml/hr may be ejected through each of the nozzles in continuous operation. The OmniDot print head has two arrays of nozzles, each array including 382 nozzles. In continuous operation each array of nozzles may print an amount of ink in the order of 200 to 400 ml/hr. Roughly speaking, if the ink chamber volume of the OmniDot would be estimated at about 150 μl and the OmniDot would eject 48 pl drops at a rate of 6.2 kHz, then it would take about 8 minutes of continuous printing to completely refresh the content of the ink chamber. In real printing environment, a nozzle on average has a duty cycle of about only 10% making the situation towards the availability of fresh ink in the nozzle much worse. A purging operating may periodically reset this situation by purging the content of the ink chamber through the nozzle in one discharge. However each purging operation result in a loss of 150 μl of ink. The through-flow configuration according to the invention eliminated these disadvantages. Firstly, the ink can be refreshed at a flow rate significantly higher than achievable by continuous printing or purging because the cross-section in the ink return path is significantly lager than that of a nozzle. The through-flow rate of ink, in excess of that necessary to replenish the ejected drops during printing, running through the ink return path may for example be chosen to be about a tenfold of the print-flow rate at continuous printing, although a through-flow rate less than or more than a tenfold of the print-flow has also shown to be working. The through-flow rate chosen may depend on the type of ink used, the physicochemical deterioration of the ink over time and as a function of operating conditions like ink or print head temperature, as well as specific print head design aspects that influence the ease of evacuating air bubbles or dust particles from the ink chamber and the required through-flow rate to do that. Secondly, the ink returned via the through-flow path is collected in a manifold and may be reused in the ink supply system. The through-flow print head may operate with a circulating ink system that continuously circulates and conditions the ink for optimal operation in the print head. Circulating ink systems have been disclosed in the art and a particular circulating ink system suitable for operating with a type of print head according to the invention has been disclosed in European patent application number 01 406 662.

The hydrostatic pressure to create the additional ink flow in the ink chamber acts like a DC component on top of the hydrodynamic pressure waves in the ink chamber controlling the drop generation and ejection process, which may be considered the AC component. Experiments show that the through-flow DC component does not disturb the drop generation and drop ejection process.

ALTERNATIVE EMBODIMENTS

So far the invention has been described in combination with a piezoelectric ink jet print head actuator as illustrated in FIG. 1. In the embodiment discussed so far, the through-flow nozzle plate may be a polyimide nozzle plate with a thickness of 125 μm affixed directly onto the front of the print head actuator and through-flow manifold assembly. The through-flow ink return paths in the nozzle plate may be manufactured in an ex situ manufacturing step (i.e. before affixing the nozzle plate onto the print head actuator) by laser ablation, etching or any other suitable technique. The nozzles may be manufactured in situ (i.e. after the nozzle plate is affixed to the print head actuator and through-flow manifold assembly) by laser ablation or other suitable techniques known in the art.

Alternative embodiment includes other types of nozzle plate materials, such as stainless steal, silicon or other ceramic nozzle plates used for ink jet print heads. These material may benefit from other manufacturing techniques to create the ink return paths and nozzles, including techniques like dicing, stamping, embossing, chemical etching, silicon etching, ion-beam, sawing, etc. The ink return paths are preferably created ex situ.

Figure 7A:
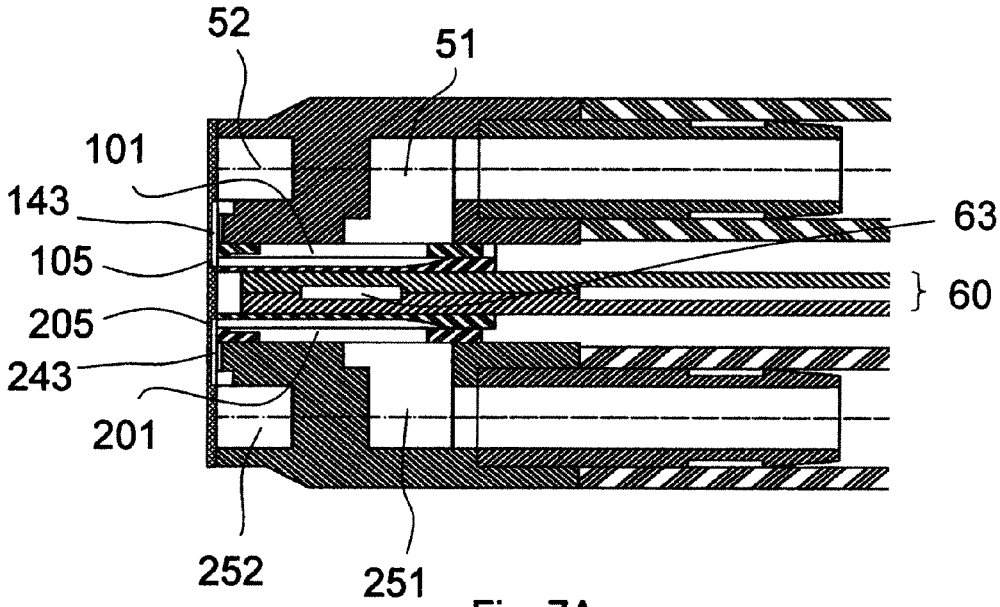
FIG. 7A shows another embodiment of the invention implemented on a back-to-back print head assembly.

One of the advantages of the invention is that the introduction of an additional ink through-flow does not require a redesign of the print head actuator, especially the ink chamber and related actuating means, and therefore hardly affects the process of generating and ejecting drops of ink from the ink chamber. The additional ink through-flow is realized by incorporating ink return paths in the nozzle plate, the ink return paths preferably being oriented perpendicular to the array of nozzles, i.e. upward or downward relative to the array of nozzles. This allows the compatibility of the invention with so called back-to-back (B2B) print head assemblies wherein two separate print head bodies are mounted back-to-back to form one print head assembly, as for example disclosed in Japanese patent publication JP-2001 096753 to Seiko Epson Corp. or commercially available as the OmniDot 760 print head from Xaar plc (UK). An embodiment of the present invention applied to these types of print heads is illustrated in FIG. 7A. The figure shows an interposer assembly 60 used as a reference for mounting a first print head actuator with through-flow manifold on the top surface and ink return paths in the nozzle plate oriented upward, and a second print head actuator with through-flow manifold at the bottom surface and ink return paths in the nozzle plate oriented downward. The interposer assembly may have a cooling channel 63 for circulating a cooling fluid, to keep the interposer assembly and the print head bodies attached to it at a constant operating temperature. As shown in FIG. 7A, the back-to-back print head assembly may use only one through-flow nozzle plate incorporating the ink return paths for both the top print head assembly and for the bottom print head assembly. Alternatively each of the print heads in the back-to-back assembly may have its own through-flow nozzle plate.

Figure 7B:
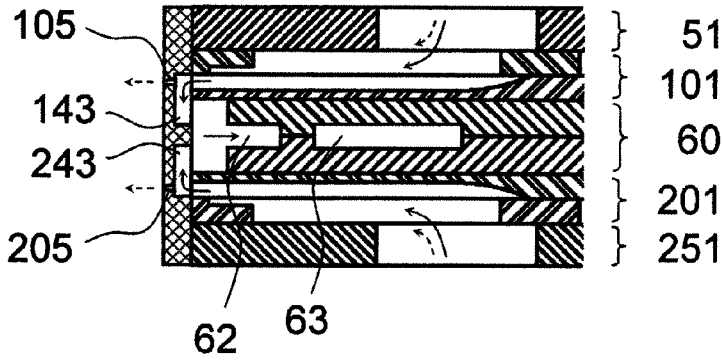
FIG. 7B shows a further integrated embodiment of a back-to-back print head assembly with a single ink outlet manifold serving both print heads' through-flow ink drain.

In a further optimization of the ink flows in a back-to-back print head assembly, the outlet manifolds of the individual print heads may be deleted and the through-flow ink may be drained via a redesigned interposer assembly having an outlet manifold functionality added to it. The ink return paths in the nozzle plate then would guide the through-flow ink towards the redesigned interposer assembly that, at that time, combines a back-to-back print head mounting functionality and a through-flow ink return functionality. The interposer assembly may for example be redesigned to incorporate an ink outlet manifold at the front, facing the ink return paths in the through-flow nozzle plate. FIG. 7B shows such a further optimized design. The interposer assembly 60 comprises a cooling channel 63 and an ink outlet manifold 62. The interposer assembly has a first print head actuator 101 mounted on top and a second print head actuator 201 mounted at the bottom. Both print head bodies have a corresponding ink inlet manifold 51 respectively 251. The single ink outlet manifold 62 integrated in the interposer assembly 60 is served by a first array of ink return paths 143 hydraulically connected with print head actuator 101 and a second array of ink return paths 243 hydraulically connected with print head actuator 201. The arrays of ink return paths may be interlaced, depending on the back-to-back print head configuration setup.

In ink jet printing in general, ink from an ink chamber is ejected through a nozzle at the ink-ejecting end of the ink chamber. The ink in the ink chamber that is ejected through the nozzle is replenished via an ink inlet to the ink chamber. The ejection process in the majority of ink jet printing processes is initiated and controlled by actuating means located in or near the ink chamber with a direct impact on the ink in the ink chamber. The flow of ink that is printed onto the printing medium, i.e. the print-flow, therefore usually is in a direction from an ink inlet to the ink chamber towards a nozzle at the ink-ejecting end of the ink chamber. The replenishment of the printed ink in the ink chamber may be controlled by capillary forces or a negative pressure in the ink chamber relative to the ink inlet manifold. As discussed previously, the print-flow may be considered an AC ink flow with a frequency range of tens to hundreds of kHz.

The ink through-flow as described in this application is not linked to the high frequency ink ejection process. The ink through-flow is neither linked to the drop by drop replenishment of ink in the ink chamber as a result of printing. The ink through-flow is actually used to continuously refresh the whole of the ink volume that is used in the high frequency ink ejection process. The ink through-flow runs from a first external ink connection to the print head to a second external ink connection to the print head and may be controlled by a pressure difference between these external connections. One of the external connections that are used to create the ink through-flow may coincide with the ink inlet manifold to the ink chamber. In the previous described embodiments, part of the ink through-flow path ran parallel with and in the same direction as the print-flow, although this is not a requirement. The ink through-flow may also run in the opposite direction, i.e. from the ink outlet manifold shown in FIG. 6 or interposer assembly shown in FIG. 7B towards the ink inlet manifold at the entry of the ink chamber, while the ink print-flow runs from the ink inlet manifold to the nozzle. The ink through-flow is a DC component that does not affect the high frequency ink ejection process and therefore may be superimposed on the AC print-flow in a positive or negative flow direction relative thereto. I.e. the solid arrows, representing the through-flow in FIGS. 6 and 7B, may also point in reverse direction while the dashed arrows, representing the print-flow, always keep their orientation.

The print heads discussed so far have an ink chamber and a print-flow orientation perpendicular to the nozzle plate. This is regular design practice in end-shooter or side-shooter type print heads. However, the applicability of the invention is not limited to this type of print head configurations. The invention is basically applicable to all print head designs wherein, if used with regular nozzle plate configurations, the print-flow stops at the nozzle plate. The invention therefore is applicable to all print head designs with an ink chamber and a print-flow incident to and with a dead-end at the nozzle plate; an ink chamber and print-flow perpendicular to the nozzle plate being a preferred embodiment for regular ink jet print heads. The physical stop at the nozzle plate does not allow a continuous ink flow through the ink chamber and along the inner end of the nozzle, i.e. the end of the nozzle facing the ink chamber, to continuously refresh the ink that is used for printing. The through-flow nozzle plate breaks through this deadlock by providing an ink return path into the nozzle plate, i.e. parallel with the nozzle plate.

Figure 9:
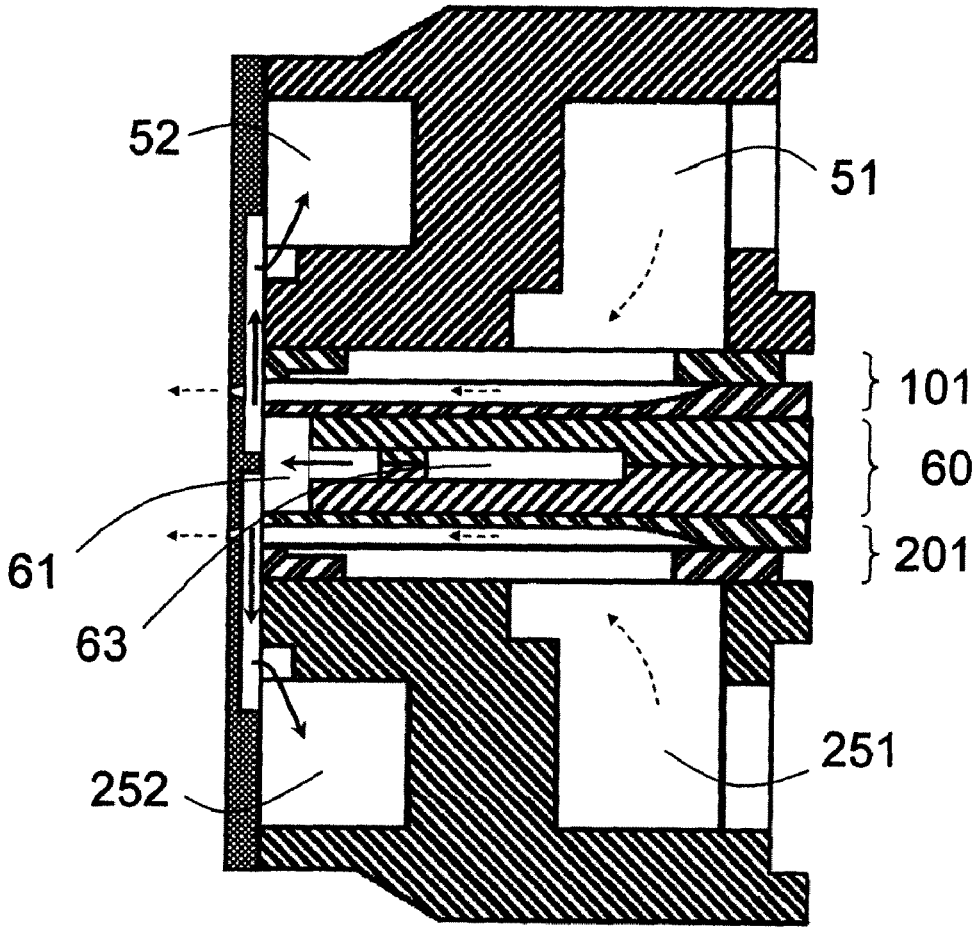
FIG. 9 shows an embodiment of the invention with an ink through-flow substantially separated from the ink print-flow.

In the previous described embodiments, the through-flow was superimposed onto the print-flow along the ink path up to the nozzle. The through-flow ink passed the inner end of the nozzle, at the bottom surface of the ink return path, and was drained via the ink return path and the outlet manifold. The through-flow continuously cleaned the inner end of the nozzle and refreshed the content of the ink chamber. In still another embodiment of the invention, a through-flow path is created separate from the print-flow path in the print head actuator. The example in FIG. 9 shows an implementation on a back-to-back print head assembly, but the principle is just as much applicable to single print head assemblies. In the print head assembly of FIG. 9, an ink through-flow starts at the ink inlet manifold 61 of interposer assembly 60, passes between the inner end of the nozzles and the front end of the ink chambers, and ends at the ink outlet manifolds 52 and 252 of the respective print head bodies 101 and 201. The ink through-flow cleans the inner end of the nozzles, evacuates air bubbles entering the print head assembly via the nozzle meniscus and creates a Bernouilli effect on the ink in the ink chambers, thereby also refreshing the ink content of the ink chambers and evacuating air bubbles or dust particles resident in the ink chambers. The ink in the ink chambers is refreshed with ink coming from the respective ink inlet manifolds 51 respectively 251, in addition to the ink replenished for print-flow use. The Bernouilli effect at the front end of the ink chamber is created by proper selection of pressure values and flow rates of the through-flow ink circulation, relative to the pressure setting used for printing.

It may be preferable to have the width of the ink return paths slightly smaller than the width of the ink chambers to allow a tolerance window for positioning the ink return paths in front of the channel openings. The depth of the return paths may be a tradeoff between flow restriction or starvation effect when the depth is too small, and loss of acoustic energy, for generating and ejecting drops of ink through the nozzle, into the return paths when they are too deep. A value in the range of about 25 μm up to about 100 μm may be chosen.

Figure 8:
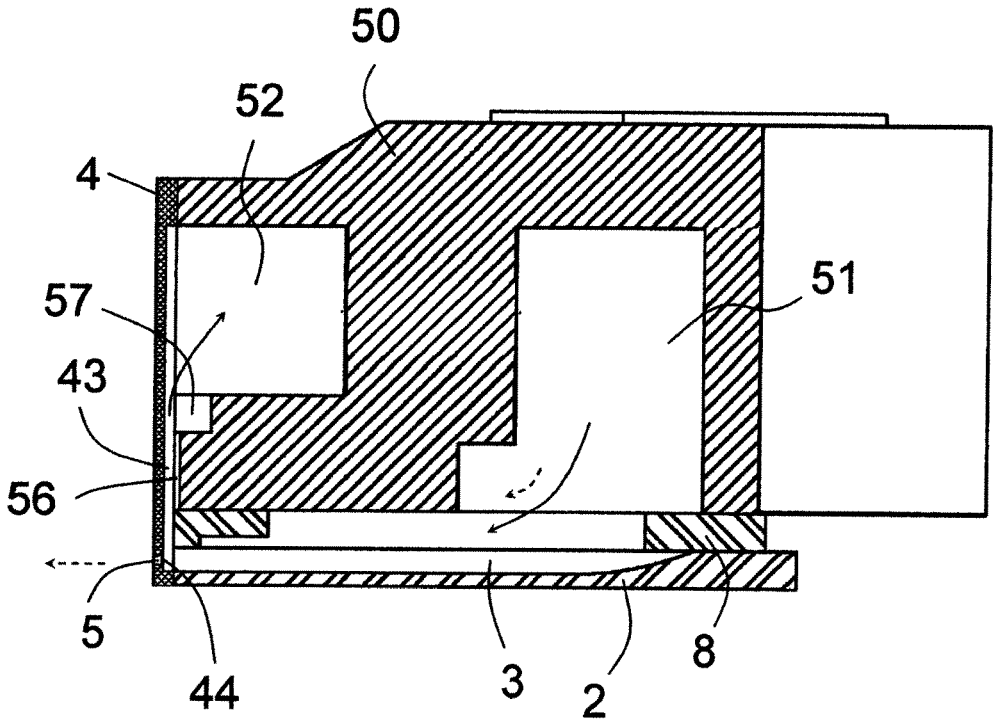
FIG. 8 shows an embodiment of the invention with extended ink return paths facing a substantial part of the ink outlet manifold.

In FIG. 6, the ink return paths start at the ink chambers and reach up to the entry step 57 to the outlet manifold. A significant area of the through-flow nozzle plate keeps its original nozzle plate thickness, which is an advantage towards overall nozzle plate stiffness, especially if the through-flow nozzle plate is made of flexible material such as polyimide. In an alternative embodiment, the ink return paths may extend further upwards and face a substantial part of the outlet manifold 52. This is illustrated in FIG. 8. The loss of overall nozzle plate stiffness, caused by the extended ink return paths, may on the other hand be an advantage towards the creation of a membrane-like front surface to the outlet manifold. The membrane properties in front of the outlet manifold may act like a damper to absorb any hitch in the ink drainage circuit and prevent pressure pulses from entering the ink return path and ink chamber to interfere with the drop generation and ejection process.

Advantages

The advantages of the through-flow nozzle plate are multiple:

- The ink in the ink chamber is continuously refreshed, up to the nozzle. The physicochemical properties of the ink used for printing can therefore be guaranteed to be in the optimal operating window.
- Any dust particles, air bubbles, and other disturbing elements that may have entered the ink in the ink supply chain, do not impede on the proper operation of the print head. It has been shown that these particles flow in and out of the print head following the main stream ink flow, i.e. the through-flow, without leaving any irreversible damage to the print head. Therefore the last chance filter assembly that is often used to catch dust particles from the ink, that possibly irreversibly block a nozzle, and which is typically mounted just before the ink chamber ink inlet, may be left out.

Air bubbles that are generated in the ink chamber, by application of the high frequency pressure waves on ink containing a percentage of dissolved air/gas, do not reside in the ink chamber but flow away with the through-flow ink stream. The same holds for air bubbles that are introduced in the ink chamber by breaking of the meniscus in the nozzle, e.g. as a result of mechanical impact of the print head.

The through-flow nozzle plate has nearly no impact on the operating conditions of the print head because the basic design of the print head actuator, i.e. dimensions of the ink chamber, flow direction of ink in the ink chamber, location of the nozzle, etc. are maintained.

It is an advantage that the inner end of the nozzle, i.e. that part of the nozzle that faces the ink chamber, is slightly further away from the front end of the ink channels. This increases the reliability of the in situ nozzle laser ablation process because the focal point of the laser is slightly further away from the ink chamber and therefore there is less probability that enough laser power enters the ink chamber and damages the interior of the ink chamber.

Figure 10:
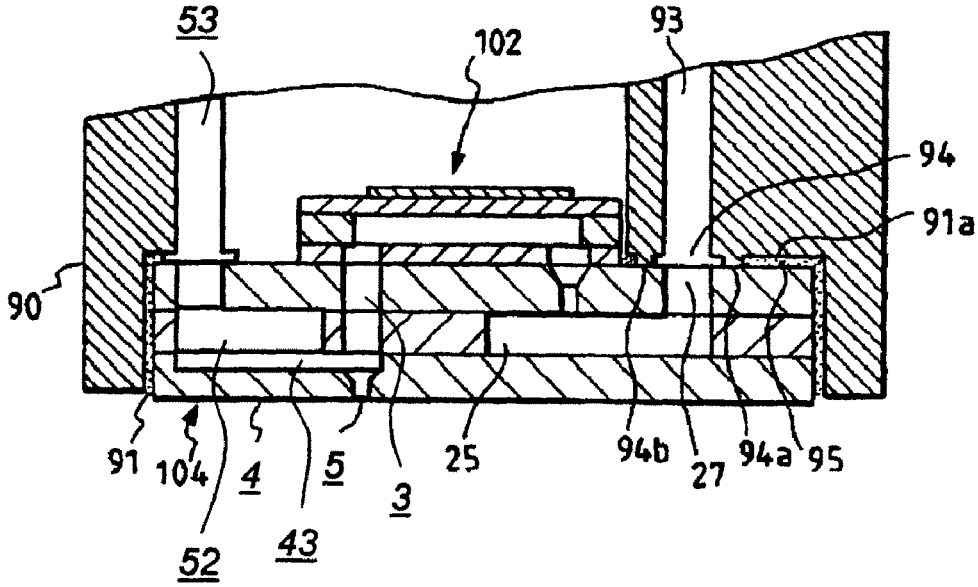
FIG. 10 shows an embodiment of the invention in a bend mode ink jet print head.
Figure 11:
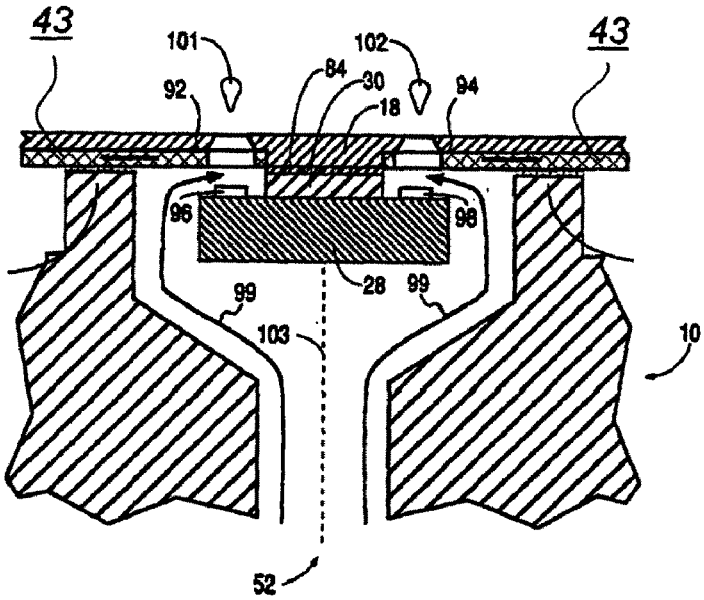
FIG. 11 shows an embodiment of the invention in a thermal ink jet print head.

The applicability of the through-flow nozzle plate is independent of the ink jet technology used to eject a drop through the nozzle, because the through-flow nozzle plate does not change the print head actuator part. So, the invention is applicable to all types of drop-on-demand ink jet print heads, including piezoelectric and thermal print heads. As an example, an embodiment of the invention used with a bend mode piezoelectric print head actuator 102, as disclosed in U.S. Pat. No. 5,748,214 to Seiko-Epson, is shown in FIG. 10. The invention related changes to the print head are referenced with italic underlined numerals. The invention hardly make changes to the actuator 102 and the elongated ink chamber 3, and may be integrated in the print head manufacturing process without adding complexity (see ink outlet manifold 52 and ink connection 53 integrated as a copy of the inlet manifold 25 and ink connection 93. In FIG. 11, an embodiment of the invention used with a double row thermal print head actuator, as disclosed in U.S. Pat. No. 5,278,584 to Hewlett-Packard Company, is shown. The added features are referenced with italic underlined numerals. Again the impact on the print head actuator design and operation hardly exists.

The nozzle in a through-flow nozzle plate according to the invention is located near the start of the ink return path. The ink flowing through the ink return path therefore passes the inner end of the nozzle and permanently cleans the inner nozzle rim.

It has been shown that the start-up time for a print head with a through-flow nozzle plate is significantly reduced.

Having described in detail preferred embodiments of the current invention, it will now be apparent to those skilled in the art that numerous modifications can be made therein without departing from the scope of the invention as defined in the appending claims.

The invention claimed is:

1. A print head for ink jet printing comprising:

an ink chamber for containing an ink, said ink chamber being elongate in a first direction;

a nozzle plate, having a nozzle for ejecting a drop of ink through it, at an end of said ink chamber with respect to said first direction;

an ink inlet to the ink chamber for supplying an ink print-flow to replenish the ejected drops, to said ink chamber;

a first ink connection for supplying an ink through-flow in excess of said ink print-flow at continuous printing, to a through-flow path; and a second ink connection for draining said ink through-flow from said through-flow path;

said through-flow path comprising an ink path for guiding said ink through-flow along an inner end of said nozzle and in a direction parallel with the nozzle plate; wherein said ink path is proximal to said nozzle plate and wherein said print head is adapted such that said ink print-flow is superimposed at least in part on said ink through-flow.

2. The print head according to claim 1, wherein said ink chamber is part of said ink through-flow path.

3. The print head according to claim 1, further comprising:

a first array of ink chambers with a corresponding first array of nozzles, a first array of ink through-flow paths comprising a first array of ink paths, for guiding said ink through-flow along the inner ends of said first array of nozzles, a first inlet manifold for distributing said ink through-flow to said first array of ink through-flow paths, and a first outlet manifold for collecting said ink through-flow from said first array of ink through-flow paths.

4. The print head according to claim 3, further comprising:

a second array of ink chambers with a corresponding second array of nozzles, and mounted back-to-back to said first array of ink chambers, a second array of ink through-flow paths comprising a second array of ink paths, for guiding said ink through-flow along the inner ends of said second array of nozzles, a second inlet manifold for distributing said ink through-flow to said second array of ink through-flow paths, and a second outlet manifold for collecting said ink through-flow from said second array of ink through-flow paths.

5. The print head according to claim 4, further comprising either a common inlet manifold providing said first inlet manifold and said second inlet manifold or a common outlet manifold providing said first outlet manifold and said second outlet manifold.

6. The print head according to claim 4, wherein said first array of ink paths or said second array of ink paths are part of a side wall of at least one manifolds manifold selected from the set of said first inlet manifold, said first outlet manifold, said second inlet manifold and said second outlet manifold.

7. An ink jet printer comprising a print head according to claim 1.

8. A method of ink jet printing comprising:

providing a print head having an ink chamber filled with an ink, said ink chamber being elongate in a first direction;

ejecting a drop of said ink through a nozzle of a nozzle plate at an end of said ink chamber with respect to said first direction;

supplying an ink print-flow to said ink chamber to replenish said ejected drop of ink;

supplying an ink through-flow in excess of said ink print-flow at continuous printing to said print head;

guiding said ink through-flow past an inner end of said nozzle; and, draining said ink through-flow from said print head; wherein the method further includes guiding said ink through-flow along a ink path proximal to said nozzle plate in a direction parallel with the nozzle plate and wherein said ink print-flow is superimposed at least in part on said ink through-flow.

9. The method according to claim 8, further comprising guiding said ink through-flow through said ink chamber.

10. The method according to claim 8, further comprising returning said ink through-flow after draining from said print head back for supplying to said print head.

11. The print head according to claim 1, wherein said ink through-flow occurs continuously during use of the print head.

12. The print head according to claim 1, wherein the direction of a portion of said ink through-flow is opposite to the direction of the superimposed portion of said ink print-flow.

13. The print head according to claim 1, wherein one of said first and second ink connections comprises said ink inlet to the ink chamber.

14. The print head according to claim 13, further comprising a through-flow manifold, wherein the other of said first and second ink connections comprises said through-flow manifold.

15. The print head according to claim 1, wherein said ink path is part of said nozzle plate.

16. The method according to claim 8, wherein said ink through-flow is supplied continuously.

17. The method according to claim 8, further comprising guiding a portion of said ink through-flow in the opposite direction to the superimposed portion of said ink print-flow.

18. The method according to claim 8, wherein said ink path is in said nozzle plate.

19. The print head according to claim 1, further comprising actuating means comprising piezoelectric material disposed along a long side of said ink chamber.

20. The print head according to claim 1, wherein said first direction is perpendicular to said nozzle plate.

21. The method according to claim 8, wherein said step of ejecting a drop of said ink comprises varying the size of said ink chamber in a direction perpendicular to said first direction.

22. The method according to claim 8, wherein said first direction is perpendicular to said nozzle plate.

* * * * *